US006988567B2

(12) United States Patent
Burnett et al.

(10) Patent No.: US 6,988,567 B2
(45) Date of Patent: Jan. 24, 2006

(54) DRILLED CUTTINGS MOVEMENT SYSTEMS AND METHODS

(75) Inventors: George Alexander Burnett, Aberdeen (GB); David Wood, Angus (GB); Kenneth W. Seyffert, Houston, TX (US); William Christian Herben, Magnolia, TX (US); James Michael McIntosh, The Woodlands, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 10/764,825

(22) Filed: Jan. 26, 2004

(65) Prior Publication Data

US 2005/0029015 A1 Feb. 10, 2005

Related U.S. Application Data

(63) Continuation-in-part of application No. 10/392,285, filed on Mar. 19, 2003.

(51) Int. Cl.
*E21B 7/12* (2006.01)

(52) U.S. Cl. ..... 175/66

(58) Field of Classification Search ..... 95/271; 55/315, 319, 459.1, 466, 467; 175/66, 5; 100/7

See application file for complete search history.

(56) References Cited

U.S. PATENT DOCUMENTS

| | | | | |
|---|---|---|---|---|
| 1,559,666 | A | 11/1925 | Bernier | |
| 2,576,283 | A | 11/1951 | Chaney | |
| 2,816,803 | A | 12/1957 | Clark et al. | |
| 2,979,235 | A | 4/1961 | Greaves | |
| 3,071,297 | A | 1/1963 | Lee | |
| 3,221,825 | A | 12/1965 | Henderson | |
| 3,420,419 | A | 1/1969 | Haslett, Jr. | |
| 3,708,207 | A | 1/1973 | Steele | 302/24 |
| 3,762,773 | A | 10/1973 | Schroeder | 302/53 |
| 3,927,757 | A | 12/1975 | Fauth | 198/37 |
| 4,059,195 | A | 11/1977 | MacDonald et al. | 214/44 R |
| 4,073,244 | A | 2/1978 | Snowdon | 110/165 R |
| 4,085,975 | A | 4/1978 | Bilkvist | 302/23 |
| 4,098,412 | A | 7/1978 | Shakshober | 214/15 D |
| 4,137,935 | A | 2/1979 | Snowdon | 137/242 |
| 4,165,133 | A | 8/1979 | Johnson | 406/109 |

(Continued)

FOREIGN PATENT DOCUMENTS

EP 0060137 9/1982

(Continued)

OTHER PUBLICATIONS

Int'l Preliminary Examination Report. PCT/GB2004/000762. Aug. 12, 2004, 25 pages.

(Continued)

*Primary Examiner*—Robert A. Hopkins
(74) *Attorney, Agent, or Firm*—Guy McClung

(57) ABSTRACT

Methods for moving drilled cuttings, the methods, in certain aspects, using a cuttings processor with a rotating annular screen to separate fluid from drilled cuttings and/or such methods including conveying with air under positive pressure, drilled cuttings to flow conduit apparatus; applying air under positive pressure to the flow conduit apparatus to continuously move the drilled cuttings material therethrough; continuously moving the drilled cuttings material with the air under pressure to separation apparatus; with the separation apparatus continuously separating drilled cuttings from air; wherein, in certain aspects, the drilled cuttings are included in a low density slurry with drilling fluid, drilling mud, and/or oil and wherein, in certain aspects, the separation apparatus is a cyclone separator and the drilled cuttings moved into the cyclone separator are wet; and systems for effecting such methods.

7 Claims, 11 Drawing Sheets

U.S. PATENT DOCUMENTS

| | | | | |
|---|---|---|---|---|
| 4,181,494 | A | 1/1980 | Kimberley | 432/2 |
| 4,200,412 | A | 4/1980 | Steele | 406/22 |
| 4,355,929 | A | 10/1982 | Snowdon | 406/125 |
| 4,430,030 | A | 2/1984 | Langen et al. | 406/146 |
| 4,515,503 | A | 5/1985 | Snowdon | 406/11 |
| 4,525,106 | A | 6/1985 | DiBuo et al. | 406/60 |
| 4,525,107 | A | 6/1985 | Feldsted | 406/25 |
| 4,546,783 | A | 10/1985 | Lott | 134/109 |
| 4,595,422 | A | 6/1986 | Hill et al. | 134/19 |
| 4,606,283 | A | 8/1986 | Des Ormeaux et al. | 110/250 |
| 4,662,799 | A | 5/1987 | Paul et al. | 406/14 |
| 4,726,301 | A | 2/1988 | Des Ormeaux et al. | 110/250 |
| 4,822,542 | A | 4/1989 | Kuwabara et al. | 264/50 |
| 4,834,587 | A | 5/1989 | Crawley et al. | 406/23 |
| 4,861,200 | A | 8/1989 | Lubbehusen et al. | 406/14 |
| 4,881,473 | A | 11/1989 | Skinner | 110/244 |
| 4,941,779 | A | 7/1990 | Dewitz et al. | 406/138 |
| 5,071,290 | A | 12/1991 | Johnson | 406/171 |
| 5,090,498 | A | 2/1992 | Hamill | 175/206 |
| 5,122,038 | A | 6/1992 | Malkoski | 417/313 |
| 5,129,468 | A | 7/1992 | Parmenter | 175/66 |
| 5,248,222 | A | 9/1993 | Littman et al. | 406/142 |
| 5,303,786 | A | 4/1994 | Prestridge et al. | 175/66 |
| 5,303,998 | A | 4/1994 | Whitlatch et al. | 366/3 |
| 5,310,285 | A | 5/1994 | Northcott | 588/250 |
| 5,402,857 | A | 4/1995 | Dietzen | 175/66 |
| 5,433,559 | A | 7/1995 | VandeSande | 406/145 |
| 5,439,489 | A | 8/1995 | Scalliet et al. | 44/281 |
| 5,454,957 | A | 10/1995 | Roff | 210/768 |
| 5,570,749 | A | 11/1996 | Reed | 175/66 |
| 5,624,058 | A | 4/1997 | Bailey | 222/240 |
| 5,842,529 | A | 12/1998 | Dietzen | 175/66 |
| 5,853,583 | A | 12/1998 | Shah | 210/340 |
| 5,884,715 | A | 3/1999 | Reddoch | 176/66 |
| 5,913,372 | A | 6/1999 | Dietzen | 175/66 |
| 5,996,484 | A | 12/1999 | Reddoch | 100/37 |
| 6,055,781 | A | 5/2000 | Johanson | 52/197 |
| 6,106,733 | A | 8/2000 | Wood | 210/774 |
| 6,138,834 | A | 10/2000 | Southale | 209/17 |
| 6,170,580 | B1 | 1/2001 | Reddoch | 175/66 |
| 6,179,070 | B1 | 1/2001 | Dietzen | 175/66 |
| 6,279,471 | B1 | 8/2001 | Reddoch | 100/37 |
| 6,315,813 | B1 | 11/2001 | Morgan et al. | 95/23 |
| 6,346,197 | B1 | 2/2002 | Stephenson et al. | 210/704 |
| 6,432,299 | B1 * | 8/2002 | Hensley et al. | 210/87 |
| 6,461,505 | B1 | 10/2002 | Danielsson et al. | 210/248 |
| 6,468,426 | B1 | 10/2002 | Klass | 210/304 |
| 6,491,167 | B2 | 12/2002 | Mahrenholtz et al. | 209/722 |
| 6,506,311 | B2 | 1/2003 | DeGarmo et al. | 210/788 |
| 6,533,946 | B2 | 3/2003 | Pullman | 210/787 |
| 6,582,600 | B1 | 6/2003 | Hashmi et al. | 210/512.2 |
| 6,585,115 | B1 | 7/2003 | Reddoch et al. | 209/3 |
| 6,596,169 | B1 | 7/2003 | Rong et al. | 210/512.1 |
| 6,602,181 | B2 | 8/2003 | Quintero et al. | 588/250 |
| 6,698,989 | B2 | 3/2004 | Snowdon | 414/137 |
| 6,702,539 | B2 | 3/2004 | Snowdon | 414/137.1 |
| 6,709,216 | B2 | 3/2004 | Snowdon | 414/137 |
| 6,709,217 | B1 | 3/2004 | Snowdon | 414/137.1 |
| 6,752,273 | B2 | 6/2004 | Reddoch | 209/2 |
| 6,763,605 | B2 * | 7/2004 | Reddoch | 34/58 |
| 6,793,814 | B2 | 9/2004 | Fout et al. | 210/188 |
| 6,855,261 | B2 | 2/2005 | Boutte et al. | 210/768 |
| 6,881,349 | B2 | 4/2005 | Mueller | 210/708 |
| 2001/0039887 | A1 | 11/2001 | Reddoch | 100/117 |
| 2002/0033278 | A1 | 3/2002 | Reddoch | 125/57 |
| 2002/0074269 | A1 | 6/2002 | Hensley et al. | |
| 2002/0100615 | A1 | 8/2002 | Curlett et al. | 175/65 |
| 2003/0006202 | A1 | 1/2003 | Boutte et al. | |
| 2004/0086345 | A1 | 5/2004 | Snowdon | 406/198 |
| 2004/0086360 | A1 | 5/2004 | Snowdon | 414/137.1 |
| 2004/0096298 | A1 | 5/2004 | Snowdon | 414/137.1 |
| 2004/0139866 | A1 * | 7/2004 | Lopez | 100/7 |

FOREIGN PATENT DOCUMENTS

| | | | |
|---|---|---|---|
| EP | 0 668 958 | B1 | 5/1997 |
| EP | 0 630 839 | B1 | 9/1997 |
| EP | 0 705 214 | B1 | 9/1997 |
| EP | 0 502 882 | B1 | 5/2000 |
| GB | 1386710 | | 7/1973 |
| GB | 1426035 | | 1/1974 |
| GB | 1595065 | | 1/1977 |
| GB | 2089403 | A | 6/1982 |
| GB | 2147397 | A | 9/1983 |
| GB | 2238730 | A | 5/1990 |
| GB | 2289705 | A | 5/1994 |
| GB | 2301382 | A2 | 11/1995 |
| GB | 2297202 | A | 3/1996 |
| GB | 2297702 | A | 3/1996 |
| GB | 2297702 | A | 8/1996 |
| GB | 2327442 | A | 1/1999 |
| GB | 2327958 | A | 2/1999 |
| GB | 2339443 | A | 1/2000 |
| GB | 2344336 | A | 6/2000 |
| WO | WO 95/00426 | | 1/1995 |
| WO | WO 99/04134 | | 1/1999 |
| WO | WO 99/06668 | | 2/1999 |
| WO | WO 99/22113 | | 5/1999 |
| WO | WO 01/20120 | A1 | 9/2000 |
| WO | WO 00/76889 | A1 | 12/2000 |
| WO | WO 01/00313 | | 1/2001 |
| WO | WO 01/42619 | A1 | 6/2001 |
| WO | GB 2002/004044 | | 9/2002 |

OTHER PUBLICATIONS

Experimental Observations Obtained From Long Distance Pneumatic COnveying Studies. R.D. Marcus. Pneumatech 2. Int'l Conference on Pneumatic Conveying Technology: pp. 126-149. Book Cover, & Copyright notice page; 1984.

Pneumatic Conveying Of Solids. Klinzing & Marcus. pp. 1-6, 284-288, 290-298, 426-428, and 480; 1997.

Form PCT/ISA/210 [8 pp.] and Form PCT/ISA/237 [7 pp.]: PCT/GB2004/00762: mailed Jul. 21, 2004.

"Operating and Maintenance Instructions for Don Valley Horizontal Mud Recovery Centrifuge MUD 10:" Don Valley Engineering Company Limited. 1996.

Verti-G Cuttings Dryer: Proactive enviromental protection—productive fluids recovery. SAFEGUARD SWACO. Smith/Schlumberger Col., 3pp. 2000.

Verti-G Cuttings Dryer/Dual Hopper Boosts Recovery. SAFEGUARD SWACO, a Smith/Schlumberger Co., 2pp. 2000.

Catapult Conveying Systems, Hadco Recovery Systems. 4pp. 2002.

F 0-25 Cuttings Box. Brandt, 1999.

Russian Far East. SWACO, 1 p. 2002.

Vortex Dryer. Brandt, 2001.

Enviromentally Sound. Cost-Effective Oilfield Waste Disposal. Sweco Oilfield Services. 4 pp. 1999.

Our Experience For Our Customers, Nol-Tec Europe, SRL, 49 pp. 2001.

Form PCT/ISA/206: PCT/GB2004/00762 & Annex; mailed Mar. 6, 2994: 5 pp.

Strategic Management of Waste Streams Generated by Exploration and Production Drilling Operations. Minton. 4 pp., Jul. 16, 2004.

Managing the Regulatory and Project Risks Associated with the Sub-surface Disposal of Oil-Contaminated Waste Streams, Minton. 6 pp., Mar. 2003.

* cited by examiner

DRILLED CUTTINGS MOVEMENT SYSTEMS AND METHODS

RELATED APPLICATION

This is a continuation-in-part of U.S. application Ser. No. 10/392,285 filed Mar. 19, 2003, which application is incorporated fully herein for all purposes.

BACKGROUND OF THE INVENTION

1. Field of the Invention

The present invention is directed to the movement of drilled cuttings, the positive pressure pneumatic transport of wet solids, and, in one particular aspect, to the movement of oilfield drilled cuttings or other heavy wet solids for disposal, storage or further processing.

2. Description of Related Art

The prior art discloses various methods for the positive pressure pneumatic continuous pneumatic transport of low slurry density and low particle density dry solids and non-continuous high slurry density transport of high particle density wet material. Many low density slurries typically have particles mixed with air with a specific gravity less than 1.0. The prior art discloses various methods that employ the vacuum transport of high particle and low particle density solids.

There has long been a need, recognized by the present inventors, for continuous positive pressure pneumatic transport of low slurry density, high particle density material, and in certain aspects, oilfield drilled cuttings or other oily/wet waste material.

SUMMARY OF THE PRESENT INVENTION

The present invention, in certain aspects, provides a method for moving drilled cuttings from an offshore rig located in water to a boat in the water adjacent said offshore rig, said drilled cuttings laden with drilling fluid, the method including feeding drilled cuttings from a drilling operation to a cuttings processor, the cuttings processor comprising a rotating annular screen apparatus, processing the drilled cuttings with the cuttings processor producing processed drilled cuttings and secondary material, the secondary material including drilled cuttings and drilling fluid, the processed drilled cuttings including drilling fluid, feeding the processed drilled cuttings from the cuttings processor to positive pressure blow tank apparatus, the positive pressure blow tank apparatus having a tank which receives the processed drilled cuttings from the cuttings processor, feeding the secondary material from the cuttings processor to secondary apparatus, and supplying air under pressure to the tank of the positive pressure blow tank apparatus for expelling drilled cuttings from the tank and propelling the drilled cuttings to tertiary apparatus. In one particular aspect the secondary apparatus is decanting centrifuge apparatus, the method further including processing the secondary material with the decanting centrifuge apparatus, producing secondary drilling fluid and secondary drilled cuttings. In one aspect, prior to feeding drilled cuttings from the cuttings processor to the positive pressure blow tank apparatus, the drilled cuttings are fed to mill apparatus to break up agglomerations of the drilled cuttings and then feeding them from the mill apparatus to the positive pressure blow tank apparatus.

In one aspect, in methods wherein the secondary apparatus is decanting centrifuge apparatus, the methods include processing the secondary material with the centrifuge apparatus, producing secondary drilling fluid and secondary drilled cuttings, recycling said secondary drilling fluid for reuse in a drilling operation, feeding said secondary drilled cuttings to a mill apparatus for breaking up agglomerations of said secondary drilled cuttings, feeding secondary drilled cuttings from the mill apparatus to the positive pressure blow tank apparatus; and/or prior to feeding drilled cuttings from the cuttings processor to the positive pressure blow tank apparatus, feeding said drill cuttings to mill apparatus to break up agglomerations of said drilled cuttings and then feeding said drilled cuttings from the mill apparatus to the positive pressure blow tank apparatus.

The present invention, in certain aspects, provides a method for moving drilled cuttings material, the drilled cuttings material including drilled cuttings and drilling fluid, the method includes feeding the drilled cuttings material to cuttings processor apparatus, the cuttings processor apparatus including rotating annular screen apparatus, processing the drilled cuttings material with the cuttings processor producing processed drilled cuttings and secondary material, the secondary material including drilled cuttings and drilling fluid, said processed drilled cuttings including drilling fluid, conveying with fluid under positive pressure processed drilled cuttings from the cuttings processor to flow conduit apparatus, applying air under positive pressure to the flow conduit apparatus to continuously move the processed drilled cuttings therethrough, continuously moving the processed drilled cuttings with the air under pressure to separation apparatus, and with the separation apparatus continuously separating processed drilled cuttings from the air.

The present invention, in certain aspects, provides a system for moving drilled cuttings, the system having movement apparatus for moving drilled cuttings, cuttings processor apparatus for processing the drilled cuttings for feed to tank apparatus, the cuttings processor apparatus including rotating annular screen apparatus, tank apparatus for receiving drilled cuttings from the cuttings processor apparatus, flow conduit apparatus for receiving drilled cuttings from the tank apparatus, pressurized fluid apparatus for applying air under positive pressure to the drilled cuttings and for continuously moving the drilled cuttings through the flow conduit apparatus and to separation apparatus, and separation apparatus for continuously receiving the drilled cuttings through the flow conduit apparatus, the separation apparatus for separating the drilled cuttings from air.

The present invention, in certain aspects, provides a method of conveying a paste, the paste including drilled cuttings laden with fluid, the method including feeding the paste to a cuttings processor, the cuttings processor comprising a rotating annular screen apparatus, reducing the weight of said paste with the cuttings processor by removing fluid from the paste, the cuttings processor producing produced material that includes drilled cuttings and fluid, feeding the produced material from the cuttings processor into a vessel, applying a compressed gas to the vessel to cause the produced material to flow out of the vessel, the vessel including a conical hopper portion which, at least during discharge of the produced material, forms the lower section of the vessel and the cone angle is below a critical value required to achieve mass flow of the produced material.

The present invention, in certain aspects, provides systems and methods for moving material that has a low slurry density, (e.g. with a specific gravity between 2.3 and 4.0 and, in one aspect, about 2.7 or lower) and a high particle density, (e.g. 2 lbs/gallon–4 lbs/gallon or higher) with a positive pressure pneumatic fluid, e.g. air or steam. In one particular aspect the material is a slurry that includes drilled cuttings from a wellbore, well drilling fluids, drilling muds, water, oil, and/or emulsions with the cuttings present as varying weight percents of the slurry. "Slurry density" refers to material from a well in an air flow and "particle density" refers to the material prior to its inclusion in an air flow.

In certain aspects systems and methods according to the present invention provide the continuous or almost-continuous transport of material.

In certain particular embodiments the present invention provides systems with storage facilities for solids to be moved and apparatus for mixing heavy solids to be transported with a pneumatic fluid, e.g., but not limited to, air or steam, at a positive pressure, i.e. above atmospheric pressure. In one aspect the velocity of moving solids is reduced using, e.g., a separator apparatus, and then the solids are collected in collection apparatus (e.g. tanks, boxes, storage containers). In certain aspects self-unloading tanks are used that have a positive pressure solids removal system. Such tanks may have systems for measuring the amount of solids in the tanks and providing an indication of this amount.

In one aspect the present invention provides apparatus for reduces the density of a slurry of material. Such apparatus includes decelerator/separator apparatus.

In particular embodiments in a method according to the present invention drilled cuttings are collected from a drilling rig (in one aspect, as they are produced) and then moved using positive pressure air and then flowed into a slurry expansion chamber apparatus which reduces the density of the incoming material. The slurry is then transported through conduit(s), e.g. at about 200 mph, 250 mph, or higher to separator apparatus that separates solids in the slurry from the air. The separated solids can be stored, shipped, or moved to other apparatus for further processing. In one such method about thirty-five tons per hour of solids are processed. In one aspect a slurry is, by volume, about fifty percent cuttings (plus wet fluid) and about fifty percent pneumatic fluid. In other aspects the cuttings (plus wet fluid) range between two percent to sixty percent of the slurry by volume.

It is, therefore, an object of at least certain preferred embodiments of the present invention to provide:

New, useful, unique, efficient, non-obvious systems and methods for transporting wet solids using positive pressure pneumatic fluid;

Such systems and methods in which the wet solids include drilled cuttings from a wellbore;

Such systems and methods which provide for the continuous or almost-continuous transport of low slurry density, high particle density material; and New, useful, unique, efficient and nonobvious apparatuses and devices useful in such systems and methods.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of certain embodiments of the invention may be had by references to the embodiments which are shown in the drawings which form a part of this specification.

DESCRIPTION OF EMBODIMENTS PREFERRED AT THE TIME OF FILING FOR THIS PATENT

Figure 1:
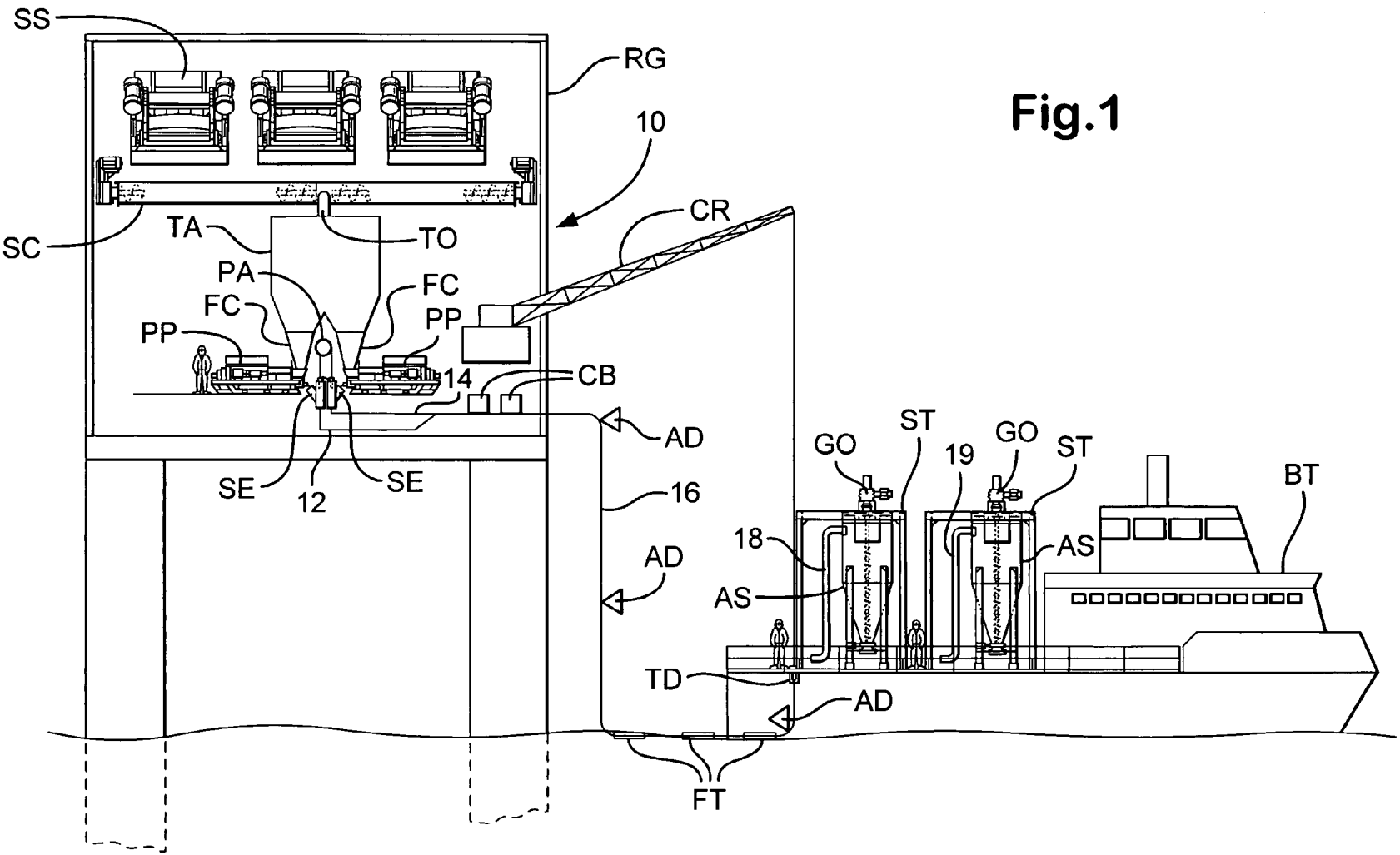
FIGS. 1–5 are schematic views of systems or parts thereof according to the present invention.

FIG. 1 shows a system 10 according to the present invention which has one or more (three shown) shale shakers SS mounted on an offshore rig RG. The shale shakers process drilling fluid having drilling solids, drilled cuttings, debris, etc. entrained therein. Separated solids and/or cuttings (with minimal liquid) exit the shale shakers S and are fed to a conveyor SC (or to any other suitable cuttings movement apparatus or device) which moves the separated solids to a feed opening TO of a tank TA.

Solids from the tank TA are pumped, optionally, by one or more pumps PP (two shown) in a line 16 and, optionally, to and through collection devices; e.g. optional cuttings boxes CB are shown in FIG. 1. Pressurized air from a pressurized air source flows to slurry expansion chambers SE in which the density of the solids pumped from the tank TA is reduced. In one particular embodiment air is provided at about 3000 cubic feet per minute to 6000 cubic feet per minute (or about 400 to 800 ACFM (actual cubic feet per minute at 100 p.s.i.) air pressure in a line 16 ranges between 15 and 40 p.s.i.; and, preferably, the solids density is relatively low, e.g. between 1 and 2 pounds per gallon of fluid flowing in the line 16. The solids are impelled from the slurry expansion chambers SE by the pressurized air into lines 12 and 14 that flow into the line 16. Desirably, one such system will process 20 to 40 tons of material per hour. Preferably solids, cuttings, etc. flow continuously in the line 16 to storage tanks on a boat BT.

Floats FT may be used with the line 16 and tether/disconnect apparatus TD provides selective and releasable connection of the line 16 to corresponding flow lines 18 and 19 of the storage tank systems ST. Optionally, air/solids separators AS may be used to remove air from the incoming fluid and/or to concentrate the solids therein. Air escapes from the systems ST via gas outlets GO and solids exiting the systems ST flow directly to a dock/shipping facility or are collected in containers on the boat BT. The line 16 and/or tether/disconnect apparatus TD may be supported by a crane CR on the rig RG. It is also within the scope of this invention for its systems and methods to be used on land.

In one particular aspect the systems ST employ self-unloading storage tanks which have one or more air inlets on their sides with pressurized air flow lines connected thereto to prevent wet solids build upon the tanks internal walls and interior surfaces and to facilitate solids movement from the tanks. Optional air assist devices AD through which air under pressure is introduced into the line 16 may be used on the line 16 to facilitate solids flow therethrough.

Figure 2:
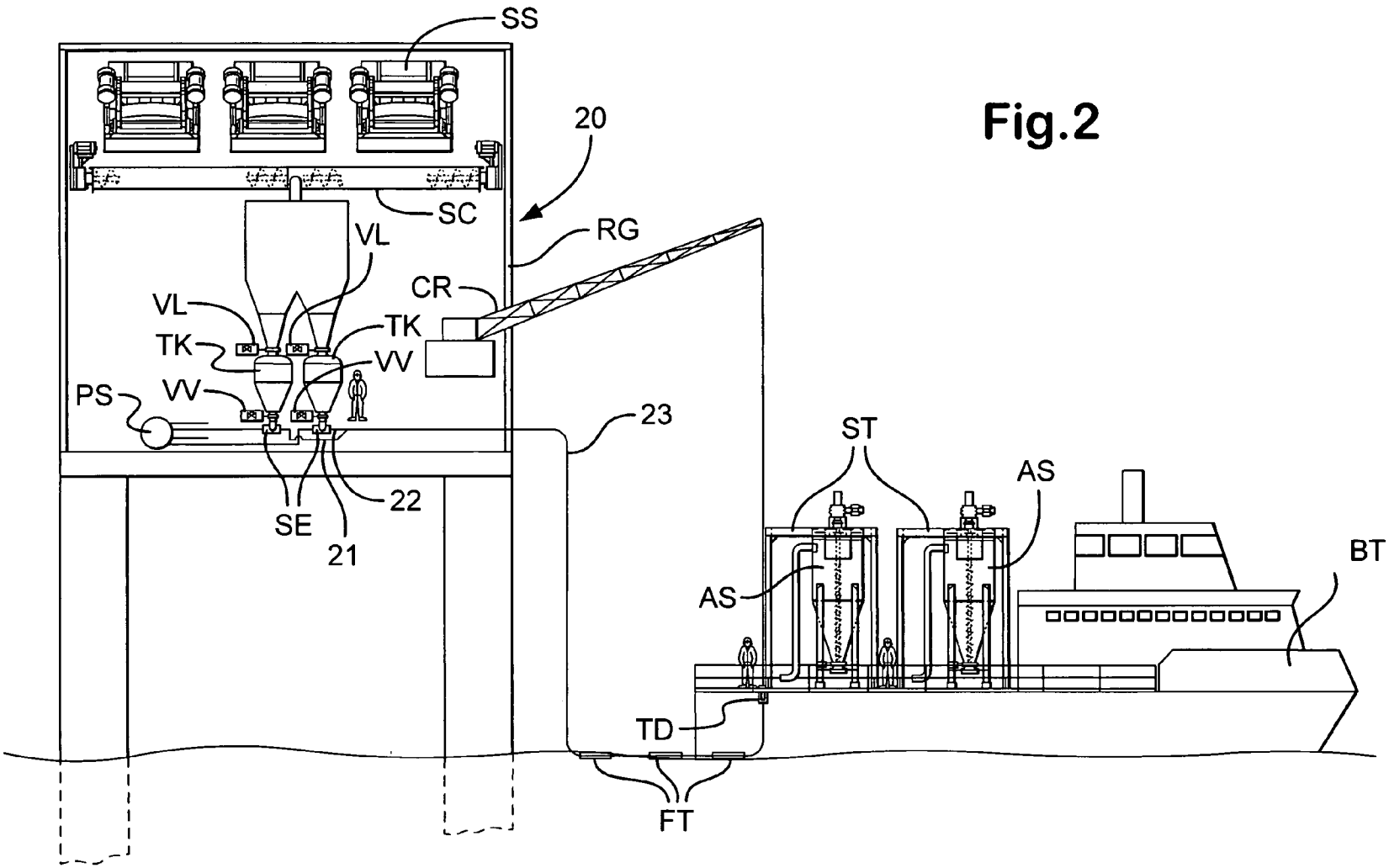

FIG. 2 shows a system 20 according to the present invention, like the system 10 (like numerals and letters indicate like parts), but with tanks TK receiving solids from the tank TA. The solids flow by gravity into the tanks TK. Alternatively, or in addition to gravity flow, the solids may be moved by suitable conveyor apparatus, screw conveyor(s), belt movement apparatus, etc. Valves VL selectively control flow into the tanks TK and valves VV selectively control flow from the tanks TK into flow lines 21, 22. Pressurized air from a pressurized air source PS forces the solids from lines 21, 22 into a line 23 (like the line 16, FIG. 1).

Figure 3:
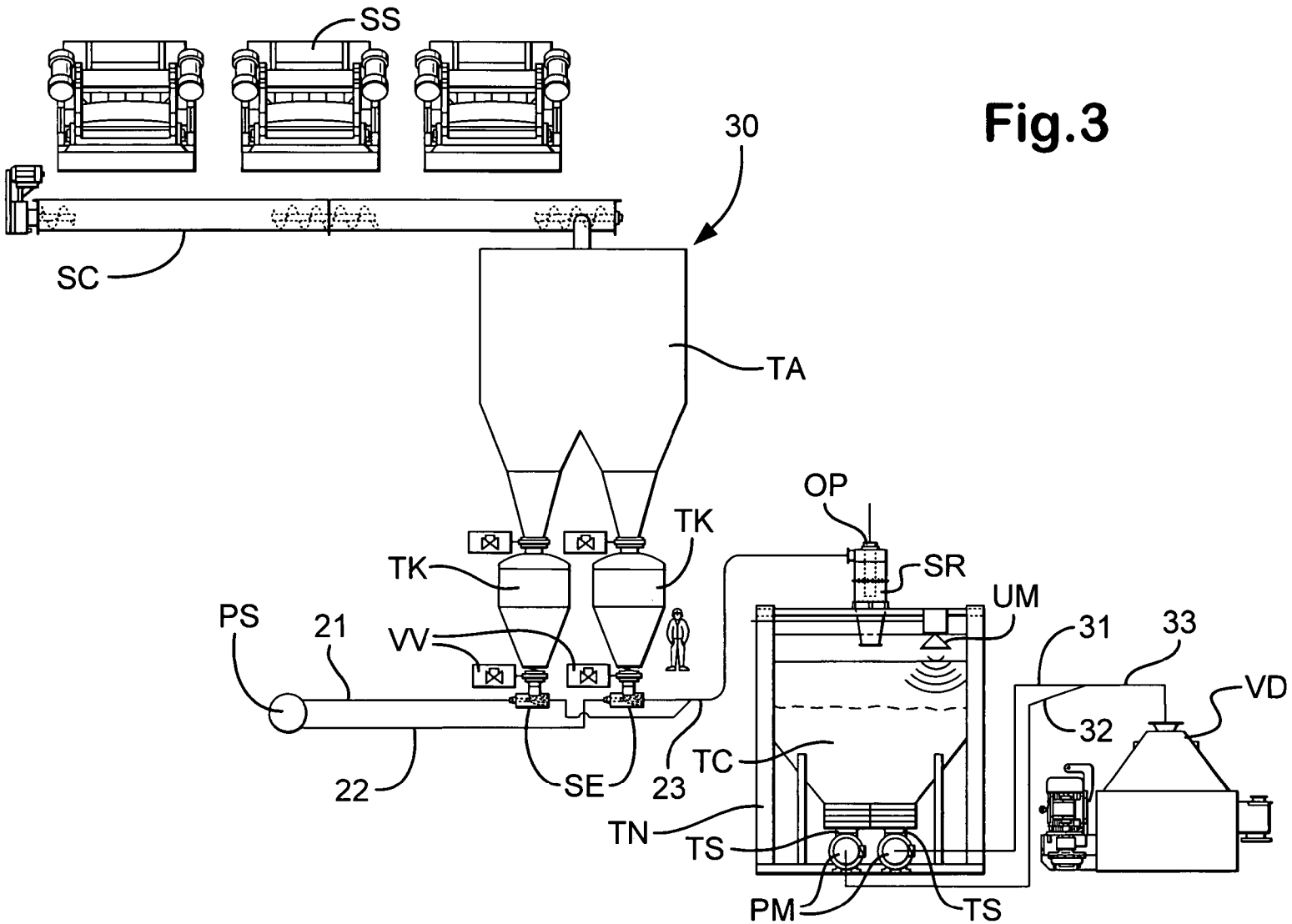
Figure 3A:
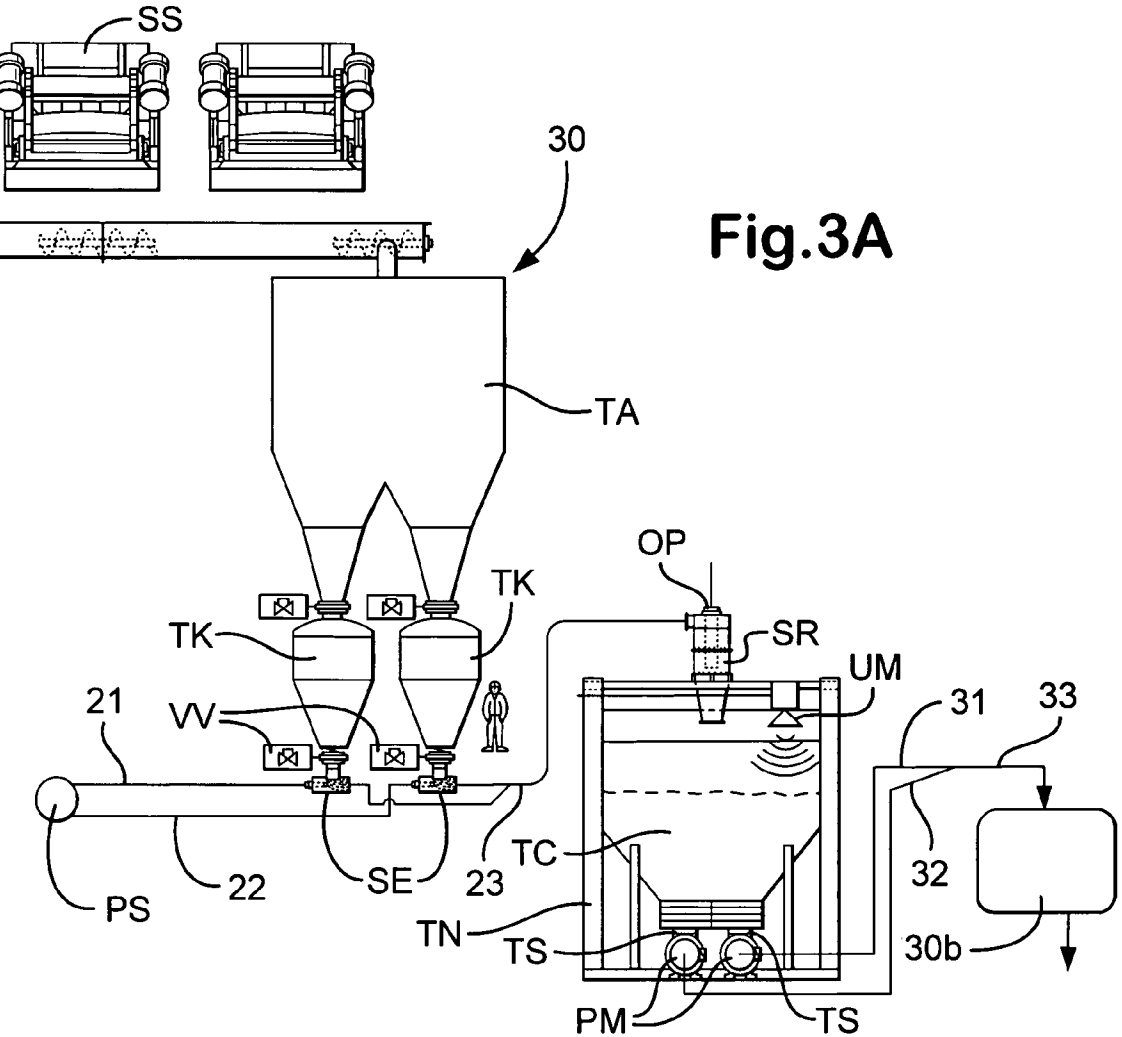

FIG. 3 shows a system 30 according to the present invention, in which some parts and apparatuses are like those of the systems 10 and 20 (like numerals and letters indicate like apparatuses and items). Material flows in the line 23 to a separator SR from which solids flow to a tank TC of a system TN. Gas (primarily if not wholly air) flows out from an opening OP of the separator SR. Pumps PM (one, two, or more) (e.g. cement pumps or progressive cavity pumps) pump solids from the tank TC in lines 31, 32 and 33 to a vortex dryer VD. In certain aspects only one of the pumps PM is operational at any given time. One, two or more tanks TC may be used. Separated solids exit from the bottom of the vortex dryer VD. In one particular aspect the cuttings coming out of the bottom of the vortex dryer are about 95% dry, i.e., 5% by weight of the solids exit stream is oil, drilling fluid, etc. In certain aspects the systems 20 and 30 achieve continuous flow of 20 to 40 tons of solids per hour. An ultrasonic meter UM indicates the depth of solids in the tank TC and tank sensors TS measure the weight of solids therein. FIG. 3A shows a system 30*a*, like the system 30, FIG. 3 (like numerals indicate like parts); but the vortex dryer VD is replaced by a cuttings processor 30*b* (like the cuttings processor 110, FIG. 10, described below).

Figure 4A:
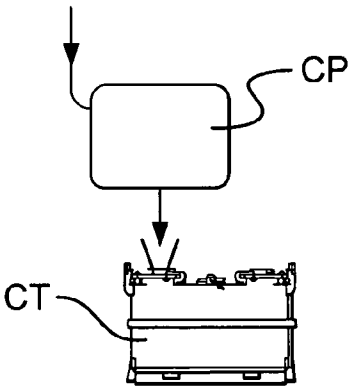
FIGS. 4A and 4B are schematic views of parts of a system according to the present invention.
Figure 4:
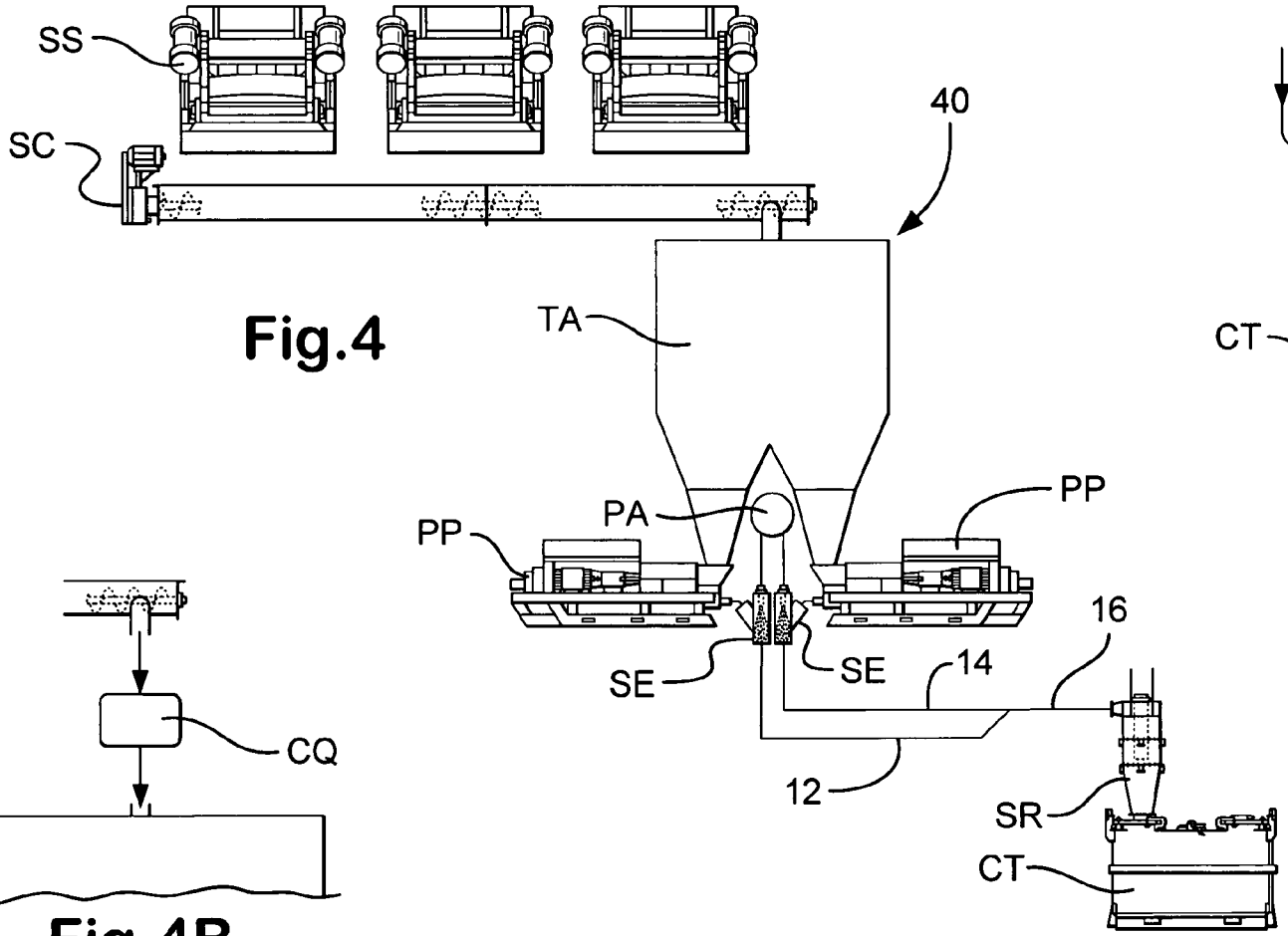

FIG. 4 shows a system 40 according to the present invention which has some apparatuses and items like the systems 10, 20 and 30 (and like numerals and letters indicate like apparatuses and items). The separator SR separates solids from air in the line and feeds them primarily via gravity (optionally with a pressurized air assist) to one or more cuttings boxes CT. Air may be vented from opening(s) in the box CT. According to the present invention a separator SR can be a separate apparatus interconnected with a tank or box in fluid communication therewith or it can be built into a tank or box as are integral part thereof. In one particular aspect the cuttings box CT is a commercially available Brandt FD-25 (Trademark) Cuttings Box. FIG. 4A illustrates that the separator SR can be replaced with a cuttings processor CP (like the cuttings processor 110, FIG. 10, described below) that feeds processed cuttings to the box CT and that any separator SR in any system herein can be so replaced.

Figure 4B:
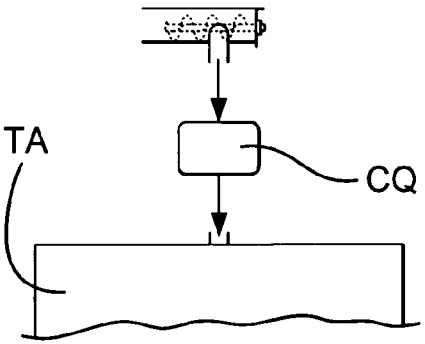
Figure 10:
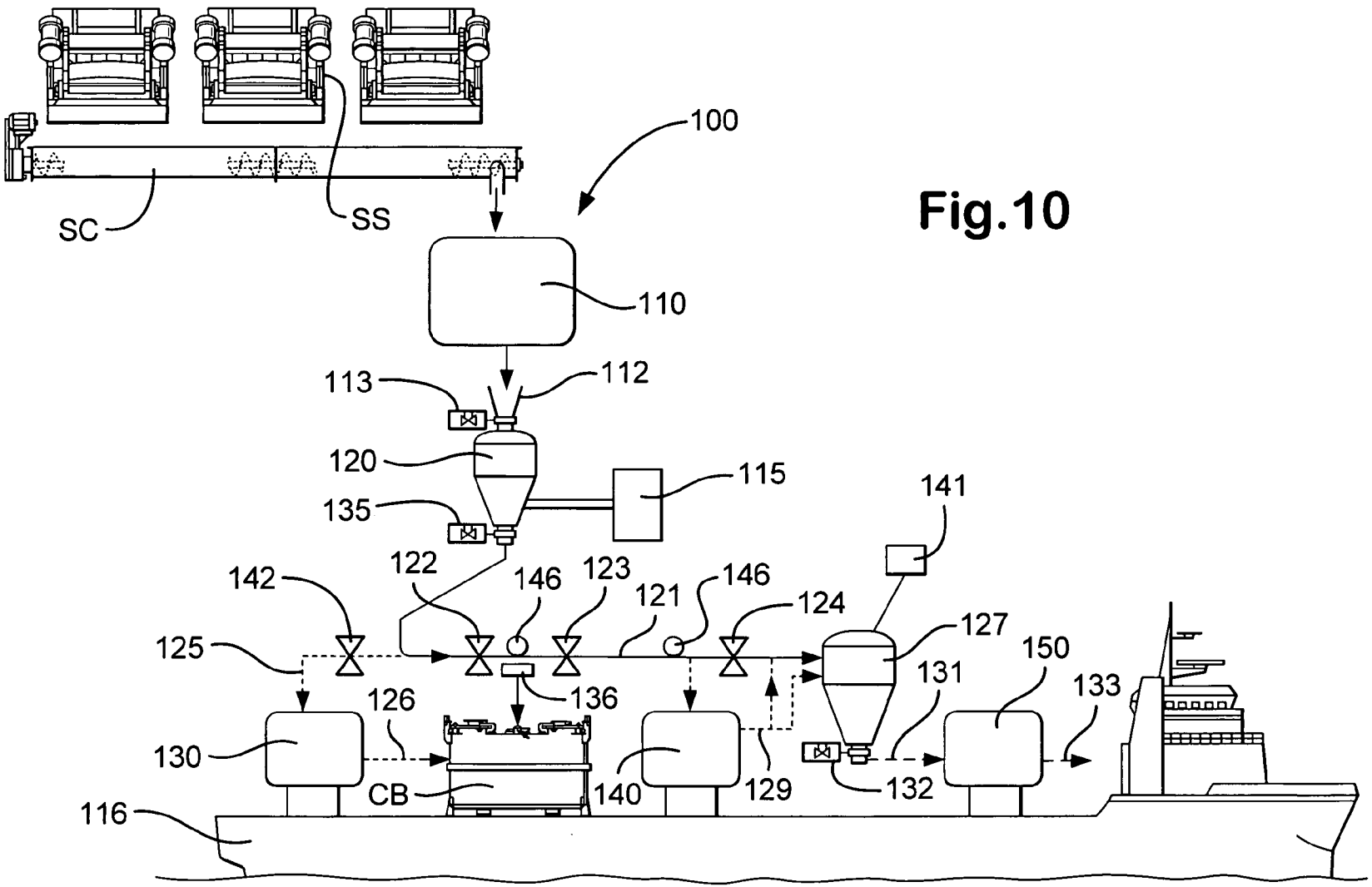
FIGS. 10 and 11 are schematic views of systems according to the present invention.

FIG. 4B illustrates that any tank TA in any system herein can be fed with cuttings from a cuttings processor CQ (like the cuttings processor 110, FIG. 10, described above).

Figure 5:
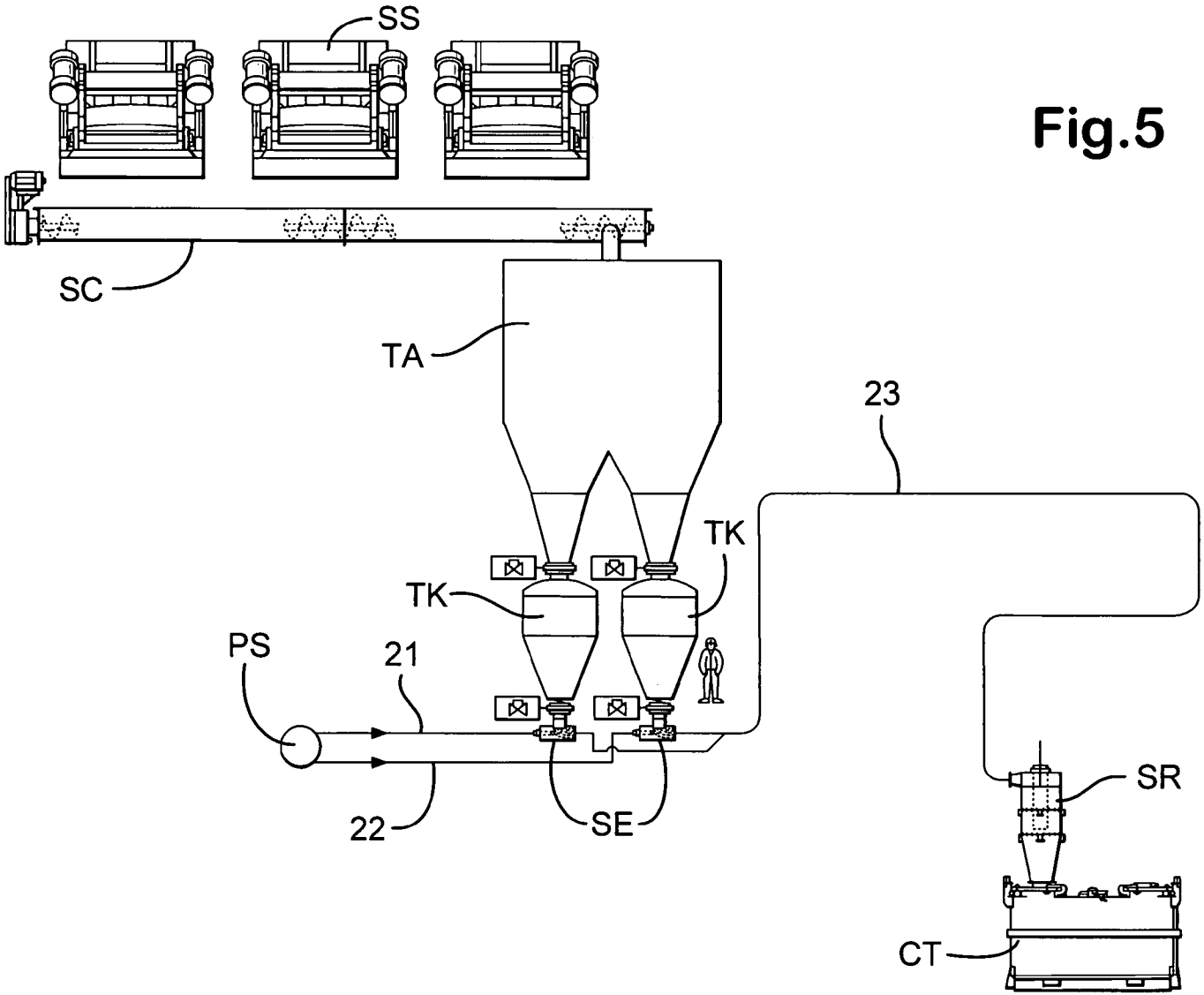
Figure 6A:
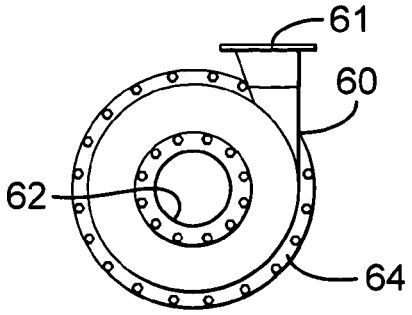
FIG. 6A is a top view of an air/solids separator according to the present invention.
Figure 6B:
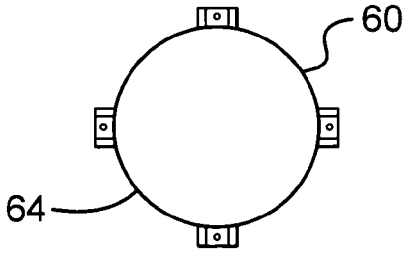
FIG. 6B is a cross-section view and FIG. 6C is a side view of the separator of FIG. 6A.
Figure 6C:
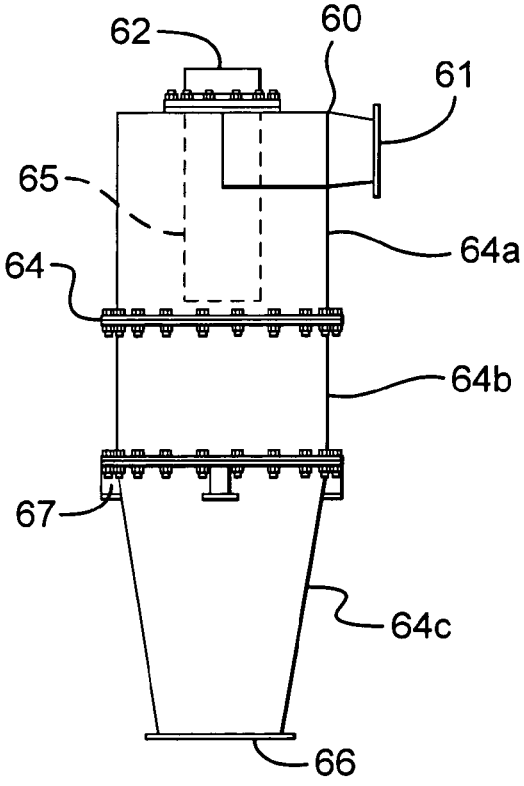
Figure 6D:
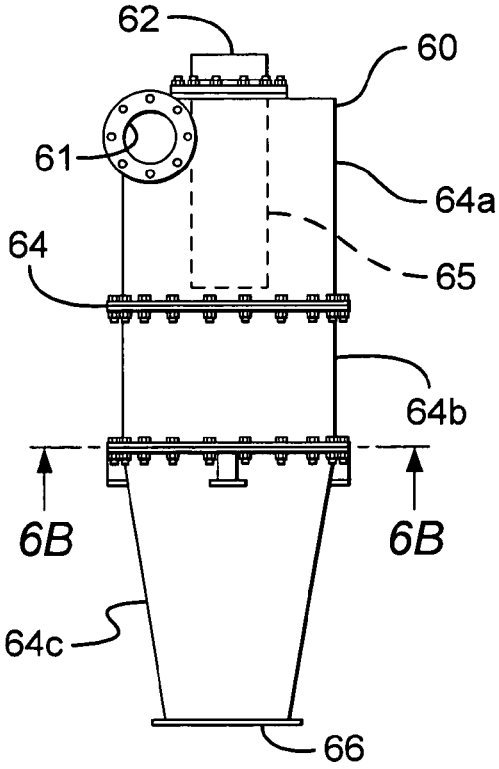
FIG. 6D is a front view of the separator of FIG. 6A.

FIG. 5 shows a system 50, like the system 20 (like numerals and letters indicate like apparatuses and items), but with material fed in the line 23 to a separator SR on a cuttings box CT.

FIGS. 6A–6D show one embodiment of a separator 60 according to the present invention which may be used as the separator SR, above. A top 64*a*, mid section 64*b*, and lower section 64*c* are bolted together to form a housing 64. Material is fed into the top section 64*a* through a feed inlet 61 that is, preferably, tangent to the diameter. Gas flows out through a top opening 62. Mounted within the housing 64 is a generally cylindrical hollow vortex finder 65. In one particular aspect the diameter of the vortex finder 65 and the diameter of a solids exit opening 66 of the lower section 64*c* are sized so that the flow from the opening 66 is primarily solids (e.g. between about 80% to 99% solids by weight) and the flow of gas out of the top opening 62 is primarily (99% or more) air; e.g. with a housing 64 that is about 48 inches in height, with a mid section 64*b* about 24 inches in diameter, the top opening 62 is about 12 inches in diameter and the bottom opening 66 is about 10 inches in diameter. It is within the scope of this invention to provide such an apparatus with dimensions of any desired size.

Mounts 67 facilitate mounting of the separator SR on a tank, rig, boat, or other structure. Any suitable support, e.g. one or more posts 68, may be used.

Figure 7:
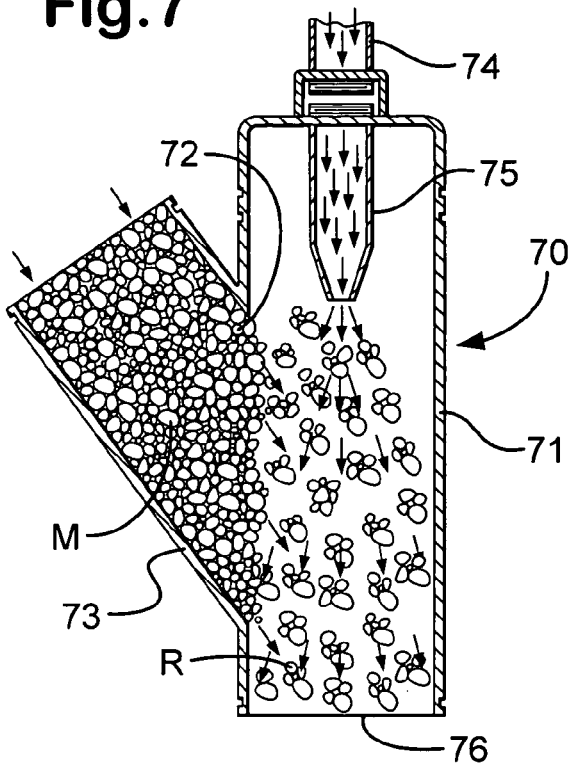
FIGS. 7 and 8 are side cross-section views of slurry expansion chamber apparatus according to the present invention.

FIG. 7 shows a slurry expansion chamber apparatus 70 according to the present invention which has a main hollow body 71 with an opening 72. Material M flows through a feed tube 73 (e.g. cuttings, fluid, and material from a wellbore) through the opening 72 into the main hollow body 71. Air under pressure from any suitable pressurized air source is introduced into a feed conduit 74 and then into a nozzle 75. The air mixes with the material M, reduces its density, and propels the reduced-density material R out through an exit opening 76. Optionally the nozzle 75 is deleted and the air flow and/or movement into the expansion chamber reduces the density of the material.

Figure 8:
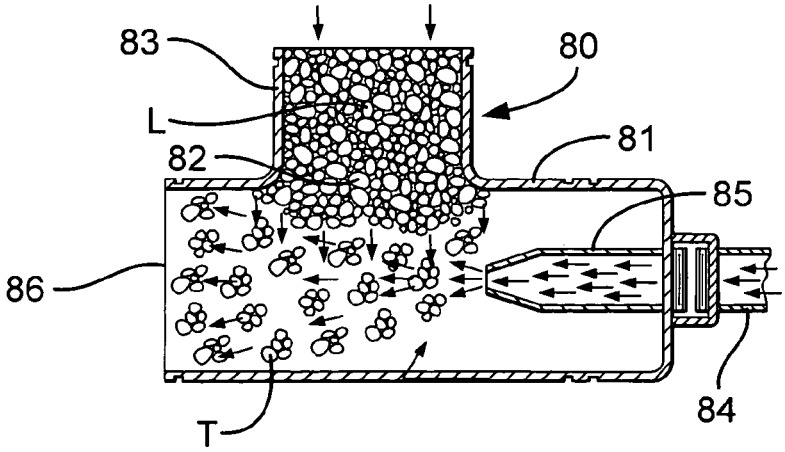

FIG. 8 shows a slurry expansion chamber apparatus 80 according to the present invention which has a main hollow body 81 with an opening 82. Material L flows through a feed tube 83 (e.g. cuttings, fluid and material from a wellbore) through the opening 82 into the body 81. Air under pressure from a pressurized air source is introduced into a feed conduit 84 and then into a nozzle The air mixes with the material L, reduces its density, and propels the reduced-density material T out through an exit opening The apparatus in FIGS. 7 and 8 may be used as the slurry expansion chamber apparatuses in the systems of FIGS. 1–5.

Figure 9:
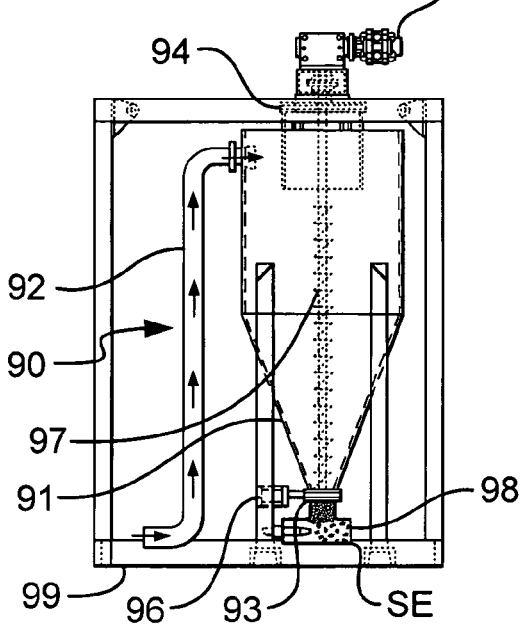
FIG. 9 is a side schematic view of a separator according to the present invention.

FIG. 9 shows an air/solids separator 90 usable as the separators AS, FIG. 1, mounted on a base 99. A mixture of air and solids is introduced into a tank 91 through a feed conduit 92. Solids flow by gravity to an exit opening 93.

Optionally, a slurry expansion chamber apparatus SE receives the solids and propels them through a pipe 98 to storage, to a collection tank or tanks, or to a cuttings box, on shore, on a rig, or on a boat or barge. Air flows out from a top opening 94.

Optionally the separator 90 may be provided with a motor apparatus 95 (e.g., a gear-box/air-motor-apparatus device) that rotates a screw 97 that inhibits or prevents the bridging of solids within the tank 91. Alternatively or in addition to such motor apparatus, devices like the air assist devices AD described above may be used to inhibit such bridging.

A valve 96 (e.g., an air-operated valve) selectively closes off the opening 93 as desired.

The present invention, therefore, in at least certain embodiments, provides a method for moving drilled cuttings material, the method including conveying with fluid under positive pressure drilled cuttings material to flow conduit apparatus, applying fluid (e.g., air or steam) under positive pressure to the flow conduit apparatus to continuously move the drilled cuttings material therethrough, continuously moving the drilled cuttings material with the fluid under pressure to separation apparatus, and with the separation apparatus continuously separating drilled cuttings from the fluid.

Such a method may also include one or some (in any possible combination) of the following: wherein the drilled cuttings are included in a low density slurry with drilling fluid; wherein the separation apparatus is a cyclone separator and the drilled cuttings moved into the cyclone separator are wet; wherein a flow pipe interconnects the separation apparatus in fluid communication with drying apparatus, the method further including flowing wet drilled cuttings through the flow pipe to the drying apparatus, and drying the wet drilled cuttings with the drying apparatus; flowing the drilled cuttings material to expansion chamber apparatus, and reducing density of the drilled cuttings material in the expansion chamber apparatus; wherein the density of the drilled cuttings material is reduced by flowing air into the material within the expansion chamber apparatus; wherein the air flows into and out through a nozzle within the expansion chamber apparatus; wherein the drilled cuttings flow in a main conduit to the separation apparatus, the main conduit having at least one air movement assistance device, the method further including facilitating movement of the drilled cuttings material through the main conduit with air from the at least one air movement assistance device; moving separated drilled cuttings from the separation apparatus to collection apparatus, the collection apparatus from the group consisting of cuttings box or boxes, tank or tanks, storage device, container or containers, and receptacle(s) on a boat or barge; wherein prior to conveying drilled cuttings material to the flow conduit apparatus the material is fed into tank apparatus, the method further including pumping the material from the tank apparatus into the flow conduit apparatus; wherein the pumping includes pumping the material from the tank apparatus into expansion chamber apparatus and therethrough into the flow conduit apparatus; wherein the tank apparatus includes valve apparatus for selectively controlling flow of the material into the flow conduit apparatus; wherein at least a portion of the flow conduit apparatus is in water and float apparatus is on the flow conduit apparatus, the method further including facilitating floating of at least a portion of the flow conduit apparatus in the water with the float apparatus; wherein the drying apparatus is a vortex dryer; wherein the drilled cuttings material is included within a slurry of material, wherein the slurry has a low slurry density, and wherein upon mixing of the slurry with the fluid under positive pressure a resultant slurry is produced, the resultant slurry having a high particle density; and/or wherein the slurry has a specific gravity between 2.3 and 4.0 and the particle density of the resultant slurry is between 2 pounds/gallon and 4 pounds/gallon.

The present invention, therefore, in at least certain embodiments, provides a method for moving drilled cuttings material, the method including conveying with fluid (e.g., air) under positive pressure drilled cuttings material to flow conduit apparatus, applying air under positive pressure to the flow conduit apparatus to continuously move the drilled cuttings material therethrough, continuously moving the drilled cuttings material with the air under pressure to separation apparatus, with the separation apparatus continuously separating drilled cuttings from the air, wherein the separation apparatus is a cyclone separator and the drilled cuttings moved into the cyclone separator are wet, wherein a flow pipe interconnects the separation apparatus in fluid communication with drying apparatus, flowing wet drilled cuttings through the flow pipe to the drying apparatus, drying said wet drilled cuttings with the drying apparatus, flowing the drilled cuttings material to expansion chamber apparatus, and reducing density of the drilled cuttings material in the expansion chamber apparatus, wherein the density of the drilled cuttings material is reduced by flowing air into said material within the expansion chamber apparatus, moving separated drilled cuttings from the separation apparatus to collection apparatus from the group consisting of cuttings box, tank, storage device, container, and receptacle on a boat, wherein the drilled cuttings material is included within a slurry of material, wherein the slurry has a low slurry density, and wherein upon mixing of the slurry with the fluid under positive pressure a resultant slurry is produced, the resultant slurry having a high particle density, and wherein the slurry has a specific gravity between 2.3 and 4.0 and the particle density of the resultant slurry is between 2 pounds/gallon and 4 pounds/gallon.

The present invention, therefore, in at least certain embodiments, provides a system for moving drilled cuttings, the system having movement apparatus for moving drilled cuttings, tank apparatus into which the movement apparatus can move the drilled cuttings, flow conduit apparatus for receiving the drilled cuttings from the tank apparatus, pressurized fluid apparatus for applying air under positive pressure to the drilled cuttings and for continuously moving the drilled cuttings through the flow conduit apparatus and to separation apparatus, and separation apparatus for continuously receiving the drilled cuttings through the flow conduit apparatus, the separation apparatus for separating the drilled cuttings from air; and such a system wherein the drilled cuttings are wet and the system further has drying apparatus for drying the drilled cuttings.

FIG. 10 shows a system 100 according to the present invention which has shale shakers SS (e.g. as in FIG. 1) whose processed solids, drilled cuttings, etc. are fed by a conveyor SC (as in FIG. 1) to a cuttings processor 110 which is a rotating annular screen apparatus, which, optionally is formed in a conical shape, e.g., as disclosed in U.K. Patent Application GB 2,297,702 A published Aug. 14, 1996 (incorporated fully herein for all purposes). (Commercially available embodiments of such annular screen apparatus are available from Don Valley Engineering Company Limited, including, but not limited to, its models MUD 8 and MUD 10.) A method using one such annular screen apparatus includes applying a mixture with drill cuttings and drilling fluid to the inner surface of an annular filter screen, rotating the annular filter screen, the annular screen having a plurality of apertures, the apertures being of a size such that the drilling fluid can pass through the apertures but drill cuttings with oil are substantially prevented from passing through the apertures. The cuttings processor 110 significantly reduces the amount of fluid in the drilled cuttings; e.g., in one particular embodiment from about 15% to 20% fluid by weight in the drilled cuttings to about 1% to 3% therein. In one particular aspect the cuttings processor 110 and others herein like it fit within a 1 meter cube; hence they take up minimal space on a rig or on a boat.

The treated drilled cuttings are then introduced into a hopper 112 from which they flow into a blow tank 120. A valve 113 selectively controls flow from the hopper 112 to the blow tank 120. Air under pressure, e.g. at least 75 psi (in one aspect between 75 and 150 psi and in one aspect about 125 psi), flows into the blow tank 120 in a line 114 from a positive pressure air source 115. In one aspect, all of the items SS, SC, 110, 112, 120, 114 and 115 and their associated lines, valves and controls are all located on a drilling rig, in one aspect an offshore drilling rig. The blow tank 120 may be like the tanks TK and their associated apparatus, FIG. 2 or FIG. 3.

In the offshore drilling rig situation, as shown in FIG. 10, processed drill cuttings are fed from the blow tank 120 (with the valve 135 open), with a valve 123 closed, and a valve 122 and 136 open, and with a valve 142 closed, in a line 121 to a cuttings box CB (like those described above) on a ship 116 in the water adjacent the offshore rig. Optionally with valve 36 closed and valve 124 open, the drilled cuttings are fed to a blow tank 127 from which they can be fed to any suitable on-ship or off-ship storage device or processing apparatus. A pressurized air source 141 on the ship provides air under pressure to the blow tank 127.

Optionally either or both of the cuttings box CB or the blow tank 127 can be fed with drilled cuttings processed by a cuttings processor 130 or 140, respectively, as indicated by the dotted lines in FIG. 10. In one aspect with the valve 122 closed and a valve 142 open, drilled cuttings are fed from the blow tank 120 in a line 125 to a cuttings processor 130 (like the cuttings processor 110) and processed cuttings are fed in a line 126 to the cuttings box CB. In one aspect with the appropriate valves open and the appropriate valves closed, including a valve 124 closed, drilled cuttings are fed in a line 128 from the blow tank 120 to a cuttings processor 140 (like the cuttings processor 110) and processed cuttings are fed in a line 129 to the blow tank 127. A valve 132 selectively controls the flow of drilled cuttings from the blow tank 127. In one aspect drilled cuttings from the blow tank 127 are fed in a line 131 to a cuttings processor 150 (like the cuttings processor 110) and processed cuttings flow in a line 133 from the cuttings processor 150 (e.g. to a cuttings box, to other storage apparatus, or to off-ship storage or processing.

In one particular embodiment of a system as described in FIG. 10 above, drilled cuttings conveyed to the cuttings processor 110 have 15% to 20% fluid by weight and drilled cuttings fed from the cuttings processor 110 to the hopper 112 have 1% to 3% fluid by weight. As desired any number of positive pressure air assist devices 146 can be used on the line 121. In one particular embodiment for about 1 cubic meter of total material fed to the cuttings processor 110, about 0.5 cubic meter is received by the blow tank 120.

Figure 3B:
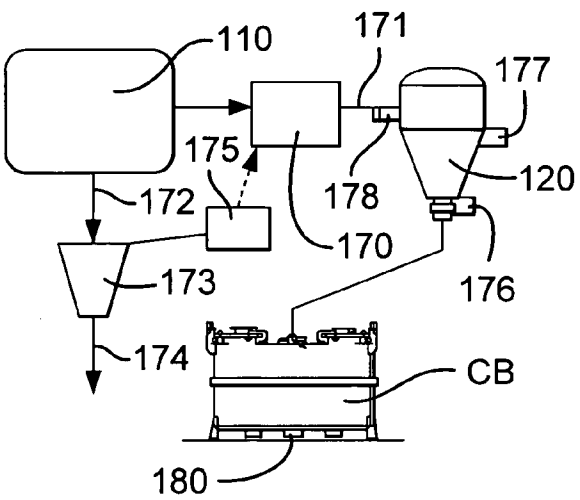

It is to be understood that the cuttings processors used in certain embodiments of the present invention (like the processor 110 and those like it) receive material that includes drilled cuttings and recoverable drilling fluid. The cuttings processor produces primary drilled cuttings whose drilling fluid component is much less by weight than the fluid-laden material in the initial feed. As shown in FIG. 3B primary drilled cuttings from the processor 110 are, in one particular embodiment, fed to mill apparatus 170 to break up agglomerated masses of drilled cuttings. The mill apparatus, in one aspect, is a pug mill. The mill apparatus 170 produces drilled cuttings with some fluid therein which are fed in a line 171 to the blow tank 120. The processor 110 also produces a secondary stream 172 that contains drilling fluid and some drilled cuttings. The stream 172, in one aspect, is fed to further processing apparatus which, in one aspect, is one or more decanting centrifuges, e.g. decanting centrifuge apparatus 173, which produces recyclable drilling fluid that exits in a line 174 and drilled cuttings 175 with some drilling fluid therein. The drilling fluid 174 is fed back into a rig mud system for re-use in a drilling operation. The drilled cuttings 175, which may be in the form of a paste, are, in one aspect, fed to the mill apparatus 170; or are fed to the blow tank 120 without milling (shown by dotted line, FIG. 3B). Any system herein may employ mill apparatus 170 and/or further processing apparatus like the apparatus 173.

As shown in FIG. 3B, to measure the amount of material within the blow tank 120 and the amount fed to and within the cuttings box CB, load cell apparatus 176 is used on the blow tank 120 and the cuttings box CB which can provide continuous monitoring of the weight of material in these apparatuses; and, optionally, ultrasonic level probes 177 monitor the level of material in these apparatuses. Optionally, timer apparatus 178 monitors the time of flow into the blow tank 120.

Figure 11:
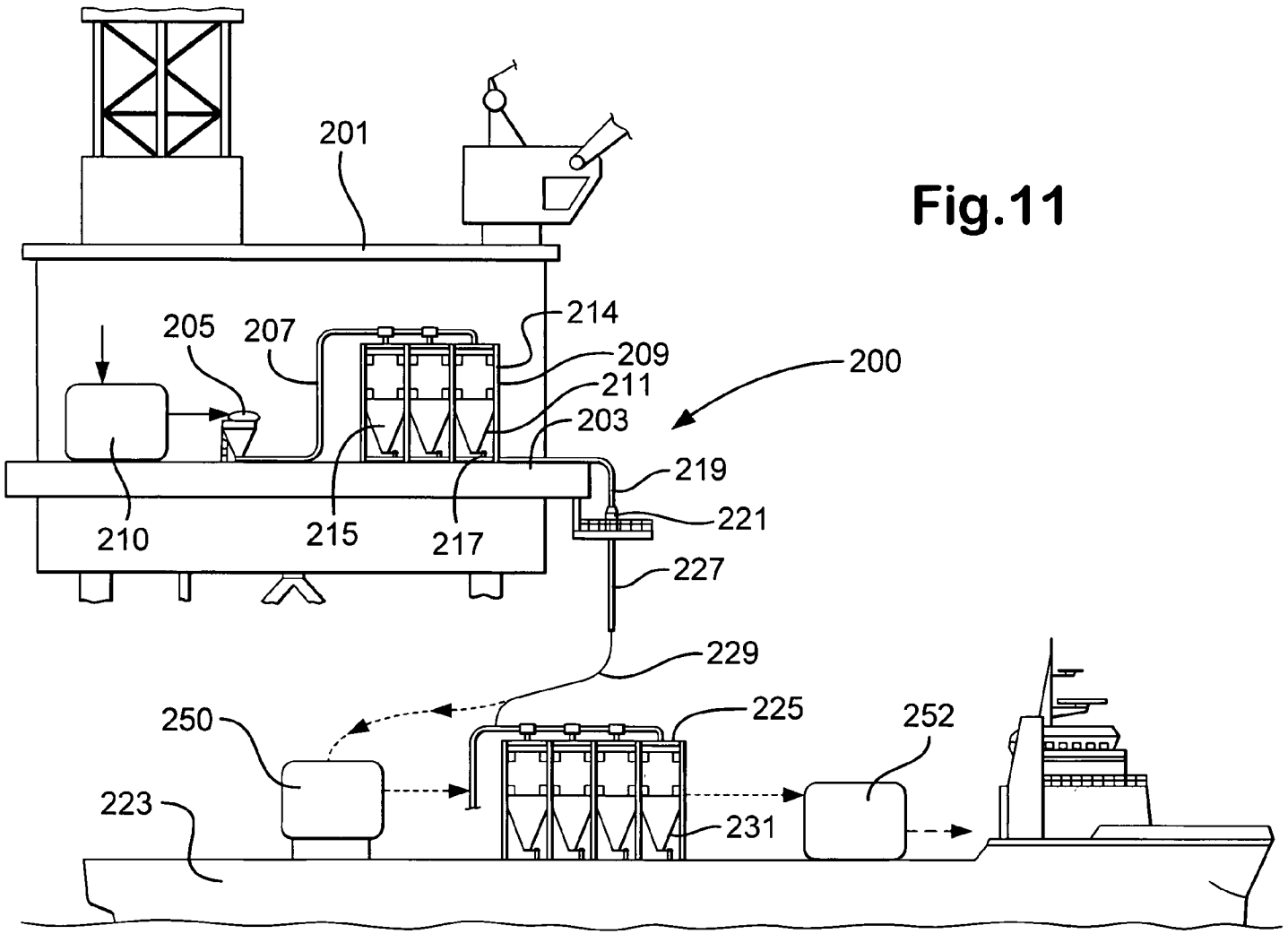

FIG. 11 shows a system 200 according to the present invention which is an improvement of systems disclosed in European Patent EP 1,187,783 B1 granted Sep. 24, 2003 (incorporated fully herein for all purposes). An offshore oil rig 201 has located on a platform 203 a pressure vessel 205 into which is loaded screened drill cuttings arising from a drilling process. The pressure vessel 205 includes an upper material inlet and a lower material outlet as well as apparatus for supplying compressed air to the interior of the vessel. The material inlet includes a valve assembly and the entire vessel may be similar to that manufactured and sold by Clyde Materials Handling Limited. Initially, drilled cuttings are fed to a cuttings processor 210 (like the processor 110, FIG. 10) and the cuttings processed by the cuttings processor 210 are fed to the pressure vessel 205. The material from the processor 210 may be a free-flowing or a non-free flowing paste depending on how much fluid the cuttings processor 210 removes.

The pneumatic conveying system, including the pressure vessel 205, follows a cycle of filling and discharging material from the pressure vessel. At the start of the cycle, the material inlet valve is closed. A vent valve is opened to equalize vessel pressure to ambient air. The inlet valve is opened and the oil cuttings/oil mixture is fed into the pressurized vessel. The vent valve is opened to vent displaced air from the vessel. When the pressurized vessel if full, the inlet valve closes. The vent valve also closes and the vessel is now sealed. An air inlet valve is opened and the material is conveyed along a pipe 207 which extends from a position below pressurized vessel 205 to an elevated position above a container assembly 209. Assembly 209 can include three ISO container sized vessels 211 located within a support framework 214. (In other embodiments, the container assembly may include a number of vessels 211 other than three.) Pipe 207 extends above the top of container assembly 209 and has downwardly extending branches leading into the inlets of each of the containers 211.

Each container 211 has a lower conical shaped hopper portion 215 and at the lowermost point of this portion there is a valve inlet 217 whereby the material within the containers 211 may be discharged via pipe 219 to a hose connection pipe 221.

A supply boat 223, fitted with a further container assembly 225, may be brought close to the oil rig 201. A flexible hose 227 is connected to pipe 219 at hose connection pipe 221. At its other end hose 227 is connected to a filling pipe 229 located on boat 223. Filling pipe 229 leads from the rear of boat 223 to a position above container assembly 225 and branch pipes extends downwardly from pipe 229 to the inlets of each of the containers 231 forming part of the containers assembly 225.

Optionally, using appropriate valving and controls (not shown) material in the flexible hose 227 is fed to a cuttings processor 250 (like the cuttings processor 110, FIG. 10) on the boat 223 which then provides processed cuttings to the container assembly 225. Optionally, cuttings from the container assembly 225 are fed to a cuttings processor 252 (like the cuttings processor 110, FIG. 10) from which processed cuttings may be provided to storage or further processing on the boat 223 and/or on shore.

Figure 12:
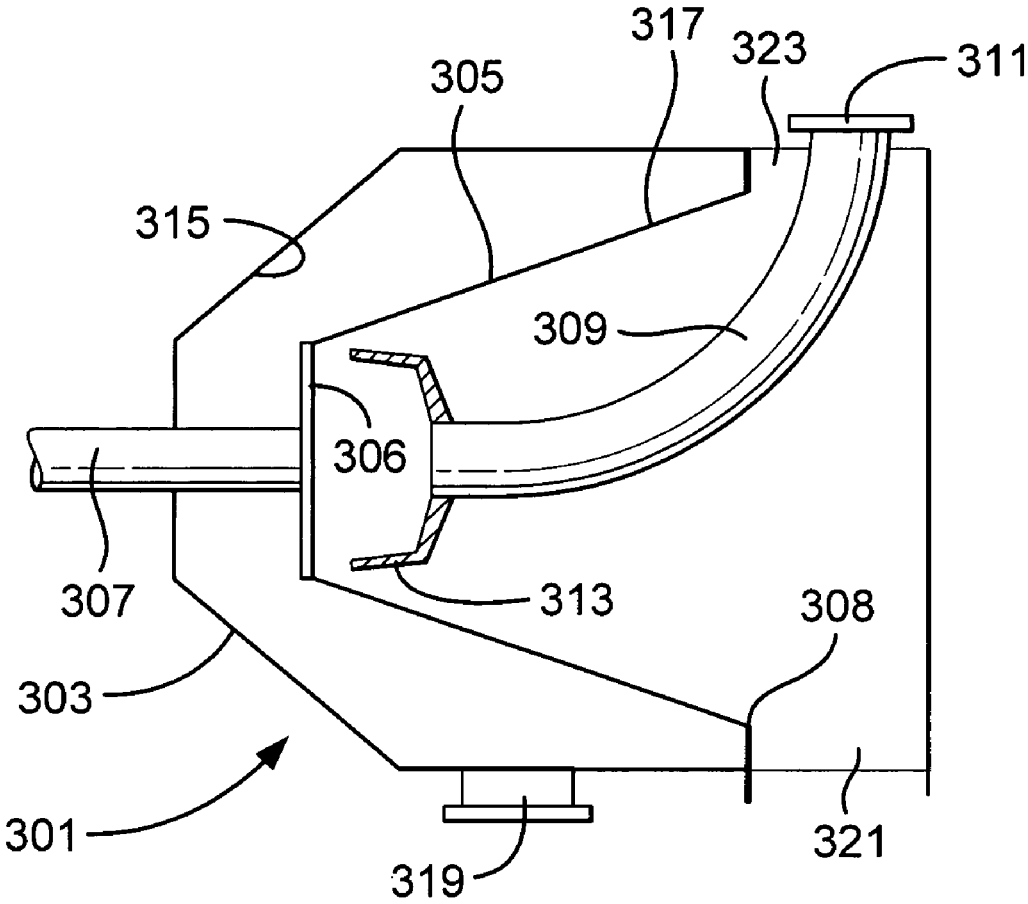
Fig.12 Prior Art
FIG. 12 is a cross-sectional view of a prior art cuttings processor.

FIG. 12 illustrates a prior art rotating annular screen apparatus as disclosed in U.K. Patent Application GB 2,297,702 A published Aug. 14, 1996, which e.g., in certain aspects, can serve as the cuttings processor 110, FIG. 10, and the like cuttings processors mentioned above.

The cuttings processor 301 in FIG. 12 is a vibrating centrifuge for use with the present invention, consisting of an outer body 303, a conical screen 305 having a small radius end 306 and a large radius end 308, a drive shaft 307 for rotating the conical screen 305 and a feed tube 209. The conical screen 305 is rotated by the drive shaft 307 with a centrifugal force acting on the conical screen 305, e.g. a force of between 10 g and 200 g. A linear motion is applied along the longitudinal axis of the drive shaft 307, e.g. with a force per unit mass of up to 5 g and an amplitude of up to 10 mm. As the conical screen 305 is directly coupled to the drive shaft 307, this linear motion is imparted onto the conical screen 305. The angle of the conical screen 305 is critical to the efficiency of the process and can range from 10 degrees to 110 degrees depending on the efficiency required. A mixture of drilling cuttings and oil, e.g., oil in oil based drilling mud, is conveyed into the input port 311, falls down the feed tube 209 and is guided onto the small radius and 306 of the conical screen 305 by a feed tube guide 313. The vibrating centrifuge separates the drilling mud from the drilling cuttings by the combination of the centrifugal force supplied by the rotating conical screen 305, the linear motion imparted on the conical screen 305 and the angle of the conical screen 305.

As the mixture of drilling mud and drilling cuttings are conveyed onto the rotating conical screen 305, the centrifugal force forces the drilling mud to migrate through apertures in the conical screen 305. However, the apertures are of a size such that the drilling cuttings are too large to migrate through the apertures in the conical screen 305, and hence are retained on an inside surface 315 of the conical screen 301. The linear motion, which is produced by the drive assembly of the vibrating centrifuge, conveys the retained drilling cuttings towards the large radius end 308 of the conical screen 305. Because of the conical form of the screen 305, as the drilling cuttings are conveyed towards the large radius end 308 of the conical screen 305, the force per unit mass acting on the drilling cuttings increases and so further removing any remaining residual oil based drilling mud from the drilling cuttings. The recovered drilling mud flows off the outside surface 317 of the conical screen 305 and exits the outer body 303 through recovered mud exit pipe 319. After the drilling cuttings have been conveyed along the length of the conical screen 305 and passed through the large radius end 308, the drilling cuttings exit the outer body 303 through dry drilling cutting exit ports 321, 323. In one particular aspect, the level of oil retained on the drilling cuttings after the cuttings have been ejected from the vibration centrifuge is reduced to between 0.015 kg and 0.04 kg of oil per kilogram of drilling cuttings.

The present invention, therefore, in at least certain embodiments, provides a method for moving drilled cuttings from an offshore rig located in water to a boat in the water adjacent said offshore rig, said drilled cuttings laden with drilling fluid, said method including feeding drilled cuttings from a drilling operation to a cuttings processor, said cuttings processor comprising a rotating annular screen apparatus; processing the drilled cuttings with the cuttings processor producing processed drilled cuttings and secondary material, the secondary material including drilled cuttings and drilling fluid, said processed drilled cuttings including drilling fluid; feeding the processed drilled cuttings from the cuttings processor to positive pressure blow tank apparatus, said positive pressure blow tank apparatus having a tank which receives said processed drilled cuttings from said cuttings processor; feeding the secondary material from the cuttings processor to secondary apparatus, and supplying air under pressure to the tank of the positive pressure blow tank apparatus for expelling drilled cuttings from said tank and propelling said drilled cuttings to tertiary apparatus. Such a method may include one or some, in any possible combination, of the following: wherein the tertiary apparatus is storage apparatus; wherein the tertiary apparatus includes a secondary positive pressure blow tank apparatus for facilitating movement of drilled cuttings from the storage apparatus; wherein drilled cuttings from the positive pressure blow tank apparatus are fed in a line to the tertiary apparatus, the line having at least one positive pressure air assist device for facilitating movement of drilled cuttings through the line, the method further include facilitating drilled cuttings movement through the line with the at least one positive pressure air assist device; wherein the cuttings processor reduces the weight of drilled cuttings processed by removing drilling fluid from said drilled cuttings, said removed drilling fluid not fed to said positive pressure blow tank apparatus; reducing a load on the positive pressure blow tank apparatus and on the tertiary apparatus by removing drilling fluid from said drilled cuttings with said cuttings processor; wherein the secondary apparatus is decanting centrifuge apparatus, the method further including processing the secondary material with the decanting centrifuge apparatus, producing secondary drilling fluid and secondary drilled cuttings; recycling said secondary drilling fluid for reuse in a drilling operation; feeding said secondary drilled cuttings to mill apparatus for breaking up agglomerations of said secondary drilled cuttings, and feeding secondary drilled cuttings from the mill apparatus to the positive pressure blow tank apparatus; and/or prior to feeding drilled cuttings from the cuttings processor to the positive pressure blow tank apparatus, feeding said drilled cuttings to mill apparatus to break up agglomerations of said drilled cuttings and then feeding said drilled cuttings from the mill apparatus to the positive pressure blow tank apparatus.

The present invention, therefore, in at least certain embodiments, provides a method for moving drilled cuttings from an offshore rig located in water to another location, in one aspect to a boat in the water adjacent said offshore rig, said drilled cuttings laden with drilling fluid, said method including feeding drilled cuttings from a drilling operation to a cuttings processor, the drilled cuttings laden with drilling fluid, said cuttings processor comprising a rotating annular screen apparatus, processing the drilled cuttings with the cuttings processor producing processed drilled cuttings and secondary material, the secondary material including drilling fluid and drilled cuttings, said processed drilled cuttings including drilling fluid, feeding processed drilled cuttings from the cuttings processor to positive pressure blow tank apparatus, said positive pressure blow tank apparatus having a tank which receives said processed drilled cuttings from said cuttings processor, supplying air under pressure to the tank of the positive pressure blow tank apparatus for expelling processed drilled cuttings from said tank and propelling said processed drilled cuttings to tertiary apparatus, wherein drilled cuttings from the positive pressure blow tank apparatus are fed in a line to the tertiary apparatus, the line having at least one positive pressure air assist device for facilitating movement of drilled cuttings through the line, the method further including facilitating drilled cuttings movement through the line with the at least one positive pressure air assist device, wherein the cuttings processor reduces the weight of drilled cuttings processed thereby by removing drilling fluid from said drilled cuttings, said drilling fluid not fed to said positive pressure blow tank apparatus, and thereby reducing a load on the positive pressure blow tank apparatus and on the further apparatus. Such a method may include the following: wherein the secondary apparatus is decanting centrifuge apparatus, the method further including processing the secondary material with the decanting centrifuge apparatus, producing secondary drilling fluid and secondary drilled cuttings, recycling said secondary drilling fluid for reuse in a drilling operation, feeding said secondary drilled cuttings to a mill apparatus for breaking up agglomerations of said secondary drilled cuttings, feeding secondary drilled cuttings from the mill apparatus to the positive pressure blow tank apparatus, and prior to feeding drilled cuttings from the cuttings processor to the positive pressure blow tank apparatus, feeding said drill cuttings to mill apparatus to break up agglomerations of said drilled cuttings and then feeding said drilled cuttings from the mill apparatus to the positive pressure blow tank apparatus.

The present invention, therefore, in at least certain embodiments, provides a method for moving drilled cuttings material, the drilled cuttings material including drilled cuttings and drilling fluid, the method including feeding the drilled cuttings material to cuttings processor apparatus, the cuttings processor apparatus having rotating annular screen apparatus, processing the drilled cuttings material with the cuttings processor producing processed drilled cuttings and secondary material, the secondary material including drilled cuttings and drilling fluid, said processed drilled cuttings including drilling fluid, conveying with fluid under positive pressure processed drilled cuttings from the cuttings processor to flow conduit apparatus, applying air under positive pressure to the flow conduit apparatus to continuously move the processed drilled cuttings therethrough, continuously moving the processed drilled cuttings with the air under pressure to separation apparatus, and with the separation apparatus continuously separating processed drilled cuttings from the air. Such a method may include one or some, in any possible combination, of the following: flowing the processed drilled cuttings to expansion chamber apparatus, and reducing density of the processed drilled cuttings in the expansion chamber apparatus; wherein the density of the drilled cuttings material is reduced by flowing air into said material within the expansion chamber apparatus; moving separated drilled cuttings from the separation apparatus to further apparatus from the group consisting of cuttings box, tank, storage device, container, receptacle on a boat, decanting centrifuge apparatus, and secondary rotating annular screen apparatus; wherein the drilled cuttings material is included within a slurry of material, wherein the slurry has a low slurry density, and wherein upon mixing of the slurry with the fluid under positive pressure a resultant slurry is produced, the resultant slurry having a high particle density; and/or wherein the slurry has a specific gravity between 2.3 and 4.0 and the particle density of the resultant slurry is between 2 pounds/gallon and 4 pounds/gallon.

The present invention, therefore, in at least certain embodiments, provides a system for moving drilled cuttings, the system including movement apparatus for moving drilled cuttings, cuttings processor apparatus for receiving drilled cuttings from the movement apparatus and for processing the drilled cuttings for feed to tank apparatus, the cuttings processor apparatus including rotating annular screen apparatus, tank apparatus for receiving drilled cuttings from the cuttings processor apparatus, flow conduit apparatus for receiving drilled cuttings from the tank apparatus, pressurized fluid apparatus for applying air under positive pressure to the drilled cuttings and for continuously moving the drilled cuttings through the flow conduit apparatus and to separation apparatus, and separation apparatus for continuously receiving the drilled cuttings through the flow conduit apparatus, the separation apparatus for separating the drilled cuttings from air.

The present invention, therefore, in at least certain embodiments, provides a method of conveying a paste, the paste including drilled cuttings laden with fluid, the method including feeding the paste to a cuttings processor, the cuttings processor comprising a rotating annular screen apparatus, reducing the weight of said paste with the cuttings processor by removing fluid from the paste, the cuttings processor producing produced material that includes drilled cuttings and fluid, feeding the produced material from the cuttings processor into a vessel, applying a compressed gas to the vessel to cause the produced material to flow out of the vessel, the vessel including a conical hopper portion which, at least during discharge of the produced material, forms the lower section of the vessel and the cone angle is below a critical value required to achieve mass flow of the produced material. In such a method the paste may be a free-flowing paste or a non-free-flowing paste; such a method may be accomplished on a rig or on a boat or partially on a rig and partially on a boat; and/or such a method may include feeding processed drilling cuttings processed by said method to a boat in water adjacent said offshore rig, said drilling cuttings having less drilling fluid therein by weight than the drilling cuttings initially fed to the cuttings processor; and in such a method fluid content of said processed drilling cuttings is at least 500% less by weight than fluid content of the drilled cuttings fed to the cuttings processor.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventor may rely on the Doctrine of Equivalents to determine and assess the scope of their invention and of the claims that follow as they may pertain to apparatus not materially departing from, but outside of, the literal scope of the invention as set forth in the following claims. Any patent or patent application referred to herein is incorporated fully herein for all purposes.

What is claimed is:

1. A method of conveying a paste, the paste including drilled cuttings laden with fluid, the method comprising feeding the paste to a cuttings processor, the cuttings processor comprising a rotating annular screen apparatus, reducing the weight of said paste with the cuttings processor by removing fluid from the paste, the cuttings processor producing produced material that includes drilled cuttings and fluid, feeding the produced material from the cuttings processor into a vessel, applying a compressed gas to the vessel to cause the produced material to flow out of the vessel, the vessel including a conical hopper portion which, at least during discharge of the produced material, forms the lower section of the vessel and the cone angle is below a critical value required to achieve mass flow of the produced material.

2. The method of claim 1 wherein the produced material fed to the vessel from the cuttings processor is a free-flowing paste.

3. The method of claim 1 wherein the produced material fed to the vessel from the cuttings processor is a non-free-flowing paste.

4. The method of claim 1 further comprising accomplishing said method on a boat.

5. The method of claim 3 further comprising feeding processed drilling cuttings processed by said method to a boat in water adjacent said offshore rig, said drilling cuttings having less drilling fluid therein by weight than the drilling cuttings initially fed to the cuttings processor.

6. The method of claim 1 further comprising accomplishing said method on an offshore drilling rig.

7. The method of claim 5 wherein fluid content of said processed drilling cuttings is at least 500% less by weight than fluid content of the drilled cuttings fed to the cuttings processor.

* * * * *